US005807097A

United States Patent [19]

Döbbeling et al.

[11] Patent Number: 5,807,097

[45] Date of Patent: Sep. 15, 1998

[54] CONE BURNER

[75] Inventors: Klaus Döbbeling, Windisch; Adnan Eroglu, Untersiggenthal; Hans Peter Knöpfel, Besenbüren; Wolfgang Polifke, Windisch; Thomas Sattelmayer, Mandach, all of Switzerland

[73] Assignee: ABB Research Ltd., Zurich, Switzerland

[21] Appl. No.: 760,688

[22] Filed: Dec. 4, 1996

[30] Foreign Application Priority Data

Dec. 27, 1995 [DE] Germany ..... 195 48 853.9

[51] Int. Cl.[6] ..... F23D 14/62

[52] U.S. Cl. ..... 431/351; 431/173; 431/353

[58] Field of Search ..... 431/173, 350, 431/351, 352, 354, 353, 284, 285, 187

[56] References Cited

U.S. PATENT DOCUMENTS 5,127,821 7/1992 Keller ..... 431/351

5,274,993 1/1994 Keller .

FOREIGN PATENT DOCUMENTS

0321809B1 6/1989 European Pat. Off. .

3707773A1 9/1988 Germany .

4426353A1 2/1996 Germany .

*Primary Examiner*—James C. Yeung

*Attorney, Agent, or Firm*—Burns, Doane, Swecker & Mathis, L.L.P.

[57] ABSTRACT

The object of the invention is to provide a novel cone burner for gaseous and/or liquid fuels which has a reduced NOx and CO emission. According to the invention, this is achieved in that the sectional cone bodies (1, 2) have a common outlet diffuser (27) at their downstream end. They have a transition region (28) to the outlet diffuser (27), in which the size of the air-inlet slots (7, 8) decreases continuously in the direction (3) of flow. The outlet diffuser (27) is designed to be circular and without air-inlet slots (7, 8).

5 Claims, 3 Drawing Sheets

FIG. 3
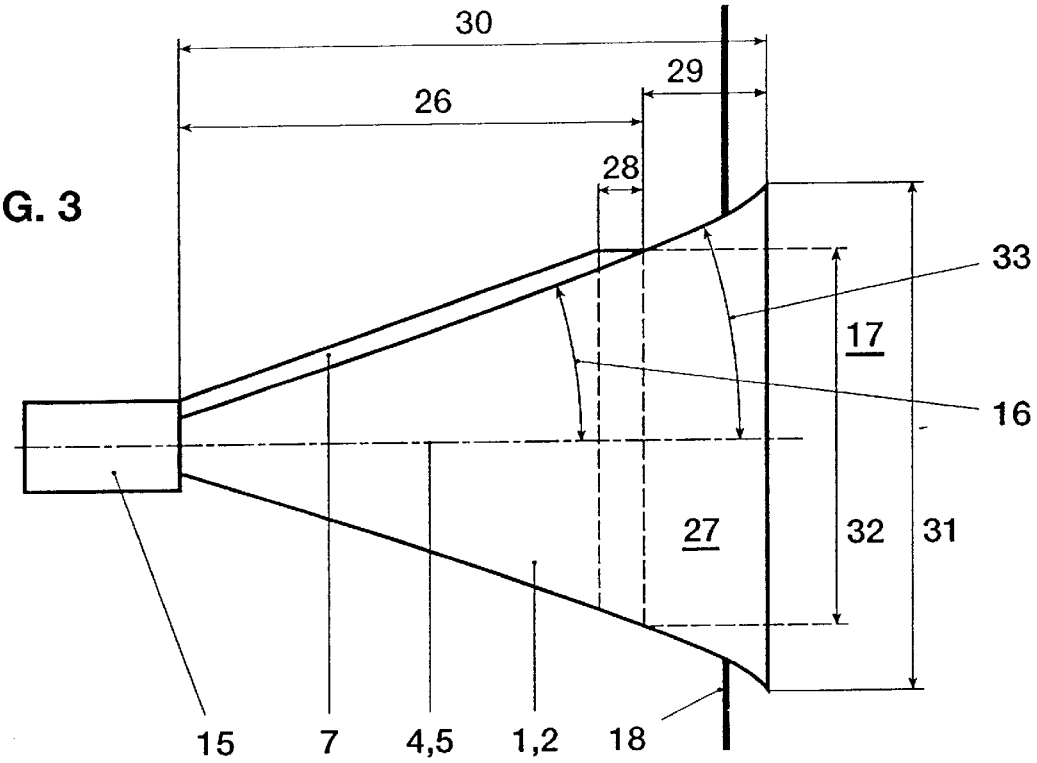
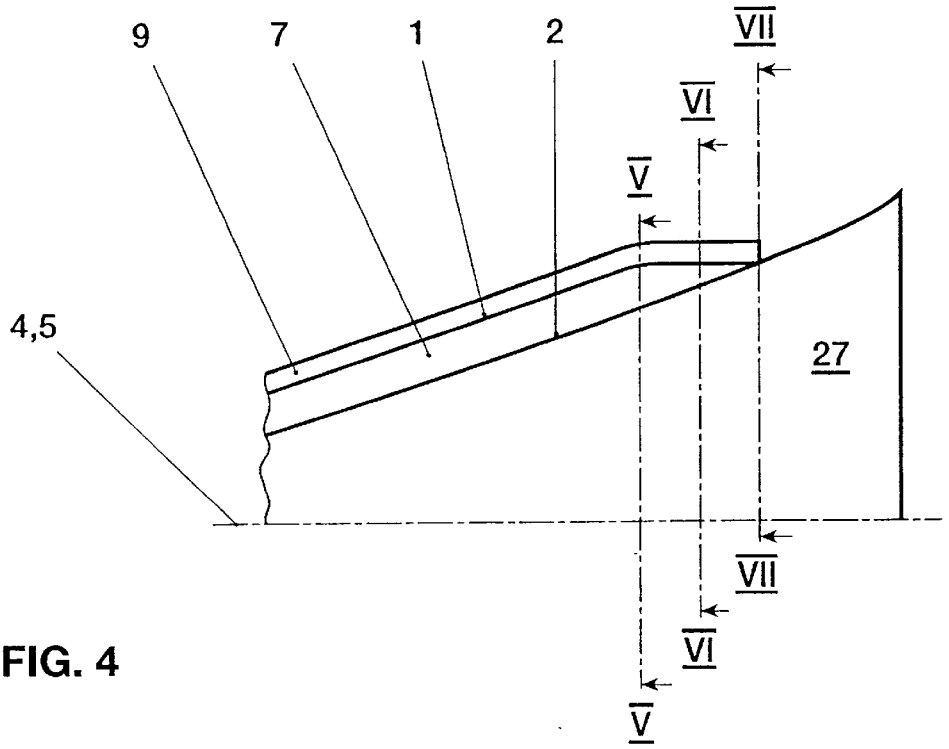
FIG. 4

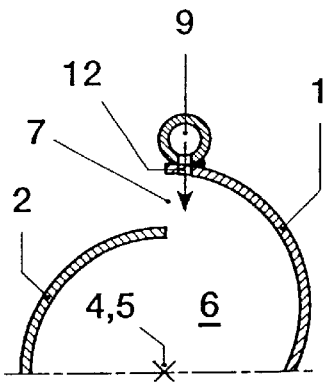
FIG. 5
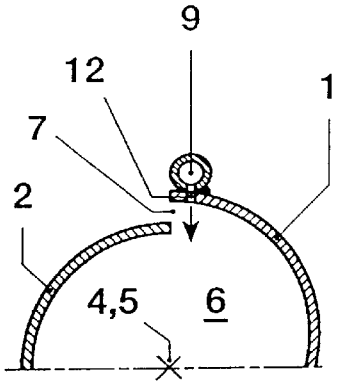
FIG. 6
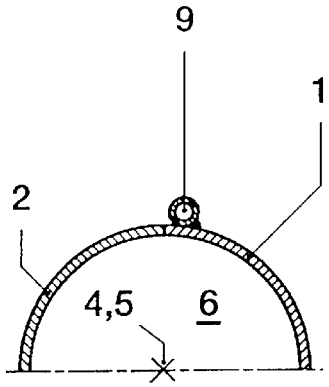
FIG. 7
FIG. 8
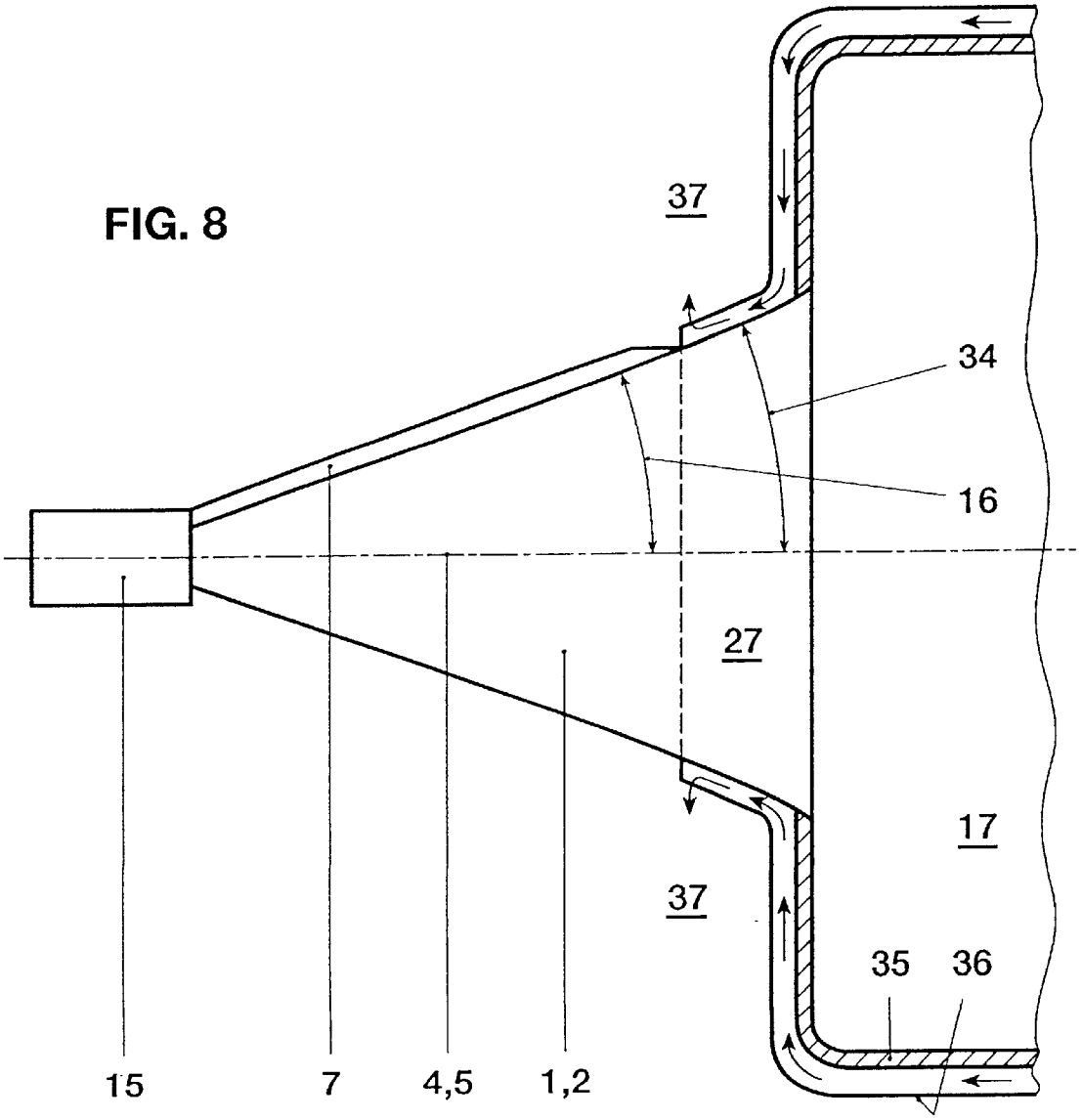

CONE BURNER

BACKGROUND OF THE INVENTION

1. Field of the Invention

The invention relates to a cone burner for gaseous and/or liquid fuels.

2. Discussion of Background

U.S. Pat. No. 4,932,861 to Keller et al. discloses a double-cone burner suitable for the combustion of gaseous and/or liquid fuels. This burner consists of two hollow sectional cone bodies which are mounted adjacent one another to form one body defining a conical interior and having tangentially-directed air-inlet slots. A line for gaseous fuel is arranged at the radial end of each air-inlet slot. The admixing of the gaseous fuel to the combustion air flowing in tangentially is therefore effected inside the air-inlet slots, specifically in the entire interior space of the burner. When liquid fuel is used, it is injected into the burner interior space via a centrally arranged nozzle.

A central backflow zone of the combustion mixture forms at the burner end of such a double-cone burner. In this region, a fuel profile homogenous on average per unit of time is achieved over the burner cross-section. The combustion mixture is ignited at the tip of the backflow zone, so that a stable flame front arises. In addition, an outer recirculation zone also forms due to the sudden widening in area toward the combustion chamber, which recirculation zone likewise helps to stabilize the flame.

When liquid fuel is used, the fuel concentration is reduced in the axial direction by the combustion air introduced tangentially, so that an effectively premixed combustion mixture results. However, gaseous fuel is introduced at the tangentially directed air inlet slots. The distance at least from the intermixing points of, which is arranged in the downstream region of the burner, up to the flame is only very small. Therefore the combustion mixture present there not yet completely homogenized per unit of time and locally leads to an increased production of nitrogen oxides and carbon monoxide.

SUMMARY OF THE INVENTION

Accordingly, one object of the invention, in attempting to avoid all these disadvantages, is to provide a novel cone burner for gaseous and/or liquid fuels which has a reduced NOx and CO emission.

According to the invention, this is achieved in a device in which the sectional cone bodies have a common outlet diffuser at their downstream end. The sectional cone bodies have a transition region to the outlet diffuser, in which the size of the air-inlet slots decreases continuously in the direction of flow. The outlet diffuser is designed to be circular and without air-inlet slots.

On account of this design of the cone burner, the vortex breakdown and thus the ignition of the combustion mixture are shifted further downstream into the vicinity of the outlet diffuser end when a suitable slot width is selected. The mixing section and mixing time available at the burner end are thereby substantially extended. A better homogenized combustion mixture thus develops, which leads to a distinct reduction in the NOx and CO emissions. This relates to the use of both liquid and gaseous fuel, the advantage in the case of the latter being considerably greater. With the continuous reduction in the size of the air-inlet slots, sudden jumps in cross section in the transition region from the cone-burner geometry to the circular outlet diffuser are prevented. In this way, separation zones of the flow of the fresh combustion mixture and thus undesirable flame retention there are avoided. The cone burner low has a circular outlet cross section toward the combustion space, whereby the cooling-air requirement for the crescents used there is dispensed with compared with the known double-cone burners. As an additional advantage, the outlet diffuser shields the reaction zone more effectively from the adjacent burners, as a result of which increased flame stability is achieved.

It is especially expedient if the diameter of the fuel feeds decreases in the direction of flow in the transition region of the sectional cone bodies. The gas hole pattern in the transition region is thus adapted in accordance with the local slot width and a uniform distribution of the gaseous fuel in the combustion air is achieved.

Furthermore, it is advantageous if the outlet diffuser has a length of about 10 to 25 percent of the overall length of the cone burner and has an outlet area which is not greater than 1.3 times a cross-sectional area, formed at the start of the transition region, of the double-cone part formed by the sectional cone bodies. Such a relatively short diffuser results in a small boundary-layer thickness, so that a flashback of the flame in the boundary layer is prevented.

In a second embodiment, the outlet diffuser has an opening angle which increases continuously in the direction of flow and is initially equal to the cone angle of the burner and is designed to be continuously greater than the cone angle in the upstream direction. The wall boundary layer is thereby stabilized and thus the risk of flow separation is minimized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a double-cone burner connected to a combustion chamber, wherein:

FIG. 3 shows a schematic representation of a double-cone burner according to the invention in side view;

FIG. 4 shows a detail from FIG. 3 with an enlarged representation of the transition region to the outlet diffuser;

FIGS. 5 to 7 show partial cross sections of the transition region along lines V—V, VI—VI, VII—VII in FIG. 4;

FIG. 8 shows a representation according to FIG. 3 but in another embodiment.

DESCRIPTION OF THE PREFERRED EMBODIMENTS

Figure 1:
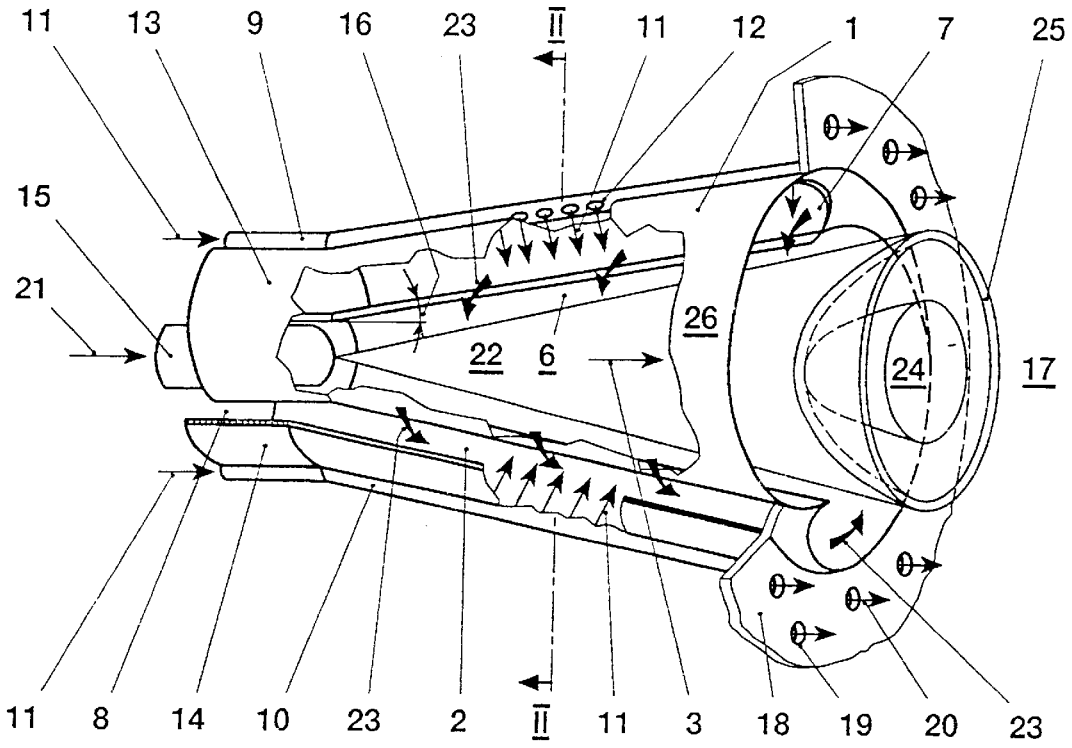
FIG. 1 (PRIOR ART)
FIG. 1 shows a double-cone burner of the prior art in perspective view and appropriate cutaway section.
Figure 2:
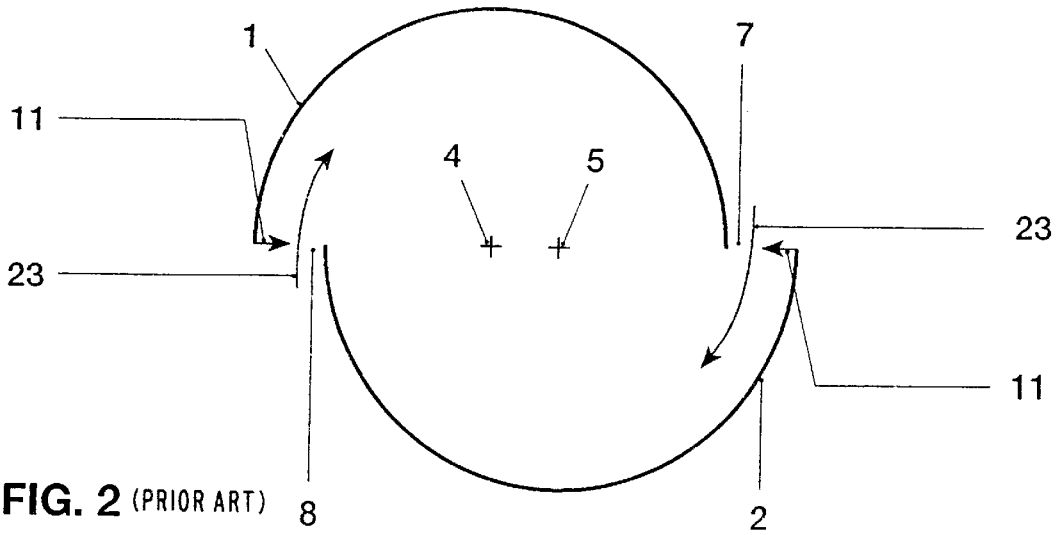
FIG. 2 (PRIOR ART)
FIG. 2 shows a schematically simplified section II—II through the burner shown in FIG. 1.

Referring now to the drawings, wherein like reference numerals designate identical or corresponding parts throughout the several views, only the elements essential for understanding the invention are shown, and the direction of flow of the working media is designated by arrows, in FIG. 1 a double-cone burner known from the prior art is shown. It consists of two half, hollow sectional cone bodies 1, 2 which are laterally offset from one another, one another to form one body relining a conical interior spare. The sectional cone bodies 1, 2 therefore have center axes 4, 5 parallel to the direction 3 of flow and mutually spaced (FIG. 2). The double-cone burner has a burner interior space 6 widening conically in the direction 3 of flow. Tangential air-inlet slots 7, 8 are formed between the sectional cone bodies 1, 2.

A fuel line 9, 10 for gaseous fuel 11 is arranged in each case at the two sectional cone bodies 1, 2, specifically at the outer end of the air-inlet slots 7, 8 (FIG. 1). The fuel lines 9, 10 are provided with a plurality of fuel feeds 12 uniformly distributed in the entire region of the air-inlet slots 7, 8 and designed as openings. Both sectional cone bodies 1, 2 each have a cylindrical tial part 13, 14, which initial parts are likewise offset from one another. The tangential air-inlet slots 7, 8 are therefore formed on the oncoming-flow side over the entire length of the double-cone burner. A central liquid-fuel nozzle 15 leading into the burner interior space 6 is arranged at the upstream end of the double-cone burner, i.e. in its cylindrical initial part 13, 14. Both sectional cone bodies 1, 2 have a flat cone angle 16 formed in the range of 10° to 30°. On the combustion-chamber side 17, a collar-like end plate 18 serving as anchorage for the sectional cone bodies 1, 2 is arranged on the double-cone burner. Formed in the end plate 18 are a number of bores 19 through which cooling air 20 for the crescent-shaped ends, located directly upstream of the end plate 18, of the sectional cone bodies 1, 2 is drawn off to the combustion chamber 17.

When liquid fuel 21 is used, it is injected at an acute angle at the narrowest cross section of the burner interior space 6. As a result, a conical fuel profile 22 forms, which is enclosed by rotating combustion air 23 flowing in via the tangential air-inlet slots 7, 8. The concentration of the liquid fuel 21 is continuously reduced in the axial direction by the intermixed combustion air 23. A central backflow zone 24 of the combustion mixture forms at the downstream end of the double-cone burner, which combustion mixture causes a vortex breakdown of the conical fuel profile 22. Good fuel concentration over the burner cross section is thereby achieved in this region. The combustion mixture is ignited at the tip of the back flow zone 24. Only at this point can a stable flame front 25 develop. If gaseous fuel 11 is burnt, it passes through the openings 12 into the burner interior space 6, in the course of which it is admixed to the combustion air 23. In the process, a conical fuel profile 22 likewise forms in the burner interior space 6.

FIG. 3 shows a schematic representation of a double-cone burner according to the invention. For reasons of clarity, only the essential components or the components modified compared with the prior art shown in FIGS. 1 and 2 are shown.

The two half, hollow sectional cone bodies 1, 2, of the burner complement one another to form one body 26 which is designed as a double-cone burner and merges downstream into a common, circular outlet diffuser 27. A transition region 28 from the double-cone part 26 to the outlet diffuser 27 is formed directly upstream of the outlet diffuser 27. In this transition region 28, the size of the air-inlet slots 7, 8 decreases continuously in the direction 3 of flow. At the same time, however, the burner cross section is widened continuously, as a result of which the area through which the combustion mixture flows also becomes larger in the transition region 28 or at least remains constant.

The outlet diffuser 27 has a length 29 of about 15 percent of the overall length 30 of the double-cone burner. Its outlet area 31 corresponds to about 1.3 times the cross-sectional area 32 at the start of the transition region 28. It has an opening angle 33 which to begin with is equal to the cone angle 16 of the burner and increases continuously in the direction 3 of flow.

The transition region 28 to the outlet diffuser 27 is shown enlarged in FIG. 4, as a result of which the arrangement and configuration of the fuel line 9 ending at the downstream end of the transition region 28 become clear.

FIGS. 5 to 7 show three partial cross sections of the double-cone part 26 in its transition region 28. The start of the transition region 28 is shown in FIG. 5, the center part is shown in FIG. 6 and the end is shown in FIG. 7. In the transition region 28, the diameter of the fuel line 9 and of the openings 12 is reduced in the direction 3 of flow. The air-inlet slots 7, 8 and the openings 12 are already completely closed at the end of the transition region 28. Neither air-inlet slots 7, 8 nor fuel lines 9, 10 are arranged at the circular outlet diffuser 27 adjoining downstream (FIG. 3).

Unlike the function, already described above, of a known double-cone burner, time and space for the intermixing of even the gaseous fuel 11 not introduced until in the downstream region of the double-cone part 26 are additionally obtained by the arrangement of the outlet diffuser 27. In this way, an optimum fuel concentration over the burner cross section is obtained. The NOx and CO emissions are clearly reduced during the combustion of such a homogenized combustion mixture. A reduction in the emissions is also achieved when using liquid fuel 21, but the advantage in this case is not so great.

In the outlet diffuser 27, the flow of the combustion mixture is slightly decelerated and thus becomes unstable in its center. The formation of the central backflow zone 24 of the combustion mixture and thus the vortex breakdown of the conical fuel profile 22 thereby occur only in the vicinity of the downstream end of the outlet diffuser 27. Since the outlet diffuser 27 is designed in a trumpet shape, a steady surface progression from the transition region 28 up to the inlet of the combustion mixture into the combustion chamber 17 is achieved. Consequently, the boundary layer does not separate in its interior, so that a stable flame front 25 can advantageously form only downstream of the double-cone burner. The location of the vortex breakdown can be influenced in accordance with the actual conditions by varying the length of the double-cone part 26, the slot width, the opening angle 32 or the number of air-inlet slots 7, 8.

On account of the continuously reduced size of the air-inlet slots 7, 8 in the transition region 28 from the double-cone part 26 to the outlet diffuser 27, a fluidically advantageous transition from the double-cone-burner geometry to the circular outlet diffuser 27 is achieved. Sudden jumps in cross section are thus avoided. The adaptation of the gas hole pattern to the local size of the air-inlet slots 7, 8 is effected by the corresponding reduction in the opening diameters. The distance between the openings 12 may of course also be increased. An additional advantage of the outlet diffuser 27 designed in a trumpet shape is the stabilizing effect of its convexely curved wall.

In a second exemplary embodiment, the outlet diffuser 27 has an opening angle 34 which is equal to the cone angle 16 of the burner (FIG. 8). On account of the simple, straight shape of the outlet diffuser 27, this double-cone burner is substantially simpler and cheaper to produce. In addition, a cooling-air baffle plate 36 is arranged outside the combustion-chamber wall 35, which cooling-air baffle plate 36 extends upstream up to the outlet diffuser 27 and ends at the downstream end of the air-inlet slots 7, 8. The outlet diffuser 27 is cooled from the outside with cooling air flowing back in the space between combustion-chamber wall 35 and cooling-air baffle plate 36, the cooling air finally leading into a plenum 37 formed upstream of the burner. On account of this convective cooling of the outlet diffuser 27, the operating reliability is further improved compared with the first exemplary embodiment.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of The United States is:

1. A cone burner for gaseous and/or liquid fuels comprising:

at least two hollow sectional cone bodies mounted adjacent one another to form a body defining a burner interior space widening conically in a direction of flow, respective center axes of the sectional cone bodies are mutually offset from one another so that the bodies define between them tangentially-directed air-inlet slots extending in the direction of flow, a plurality of gas fuel feeds mounted along the air-inlet slots and uniformly distributed over an entire region of the air-inlet slots, a central liquid-fuel nozzle arranged at an upstream end of the cone burner and directed into the burner interior space, and a common outlet diffuser mounted at a downstream end of the sectional cone bodies, having a continuous outer wall, and being circular in shape, wherein, the sectional cone bodies are shaped at an outlet end with a transition zone for joining the outlet diffuser, in which transition zone a width of the air-inlet slots decreases continuously in the direction of flow to close at a junction with the outlet diffuser.

2. The cone burner as claimed in claim 6, wherein a diameter of the fuel feeds decreases in the direction of flow in the transition zone of the sectional bodies.

3. The cone burner as claimed in claim 2, wherein the outlet diffuser has a length of about 10 to 25 percent of an overall length of the cone burner and has an outlet cross sectional area which is not greater than 1.3 times a cross sectional area, at a start of the transition zone.

4. The cone burner as claimed in claim 3, wherein the outlet diffuser has an opening angle which is equal to a cone angle of the burner.

5. The cone burner as claimed in claim 3, wherein the outlet diffuser has an opening angle which is initially equal to cone angle of the burner and increases continuously in the direction of flow.

* * * * *